United States Patent [19]

McGrane

[11] 4,014,471

[45] Mar. 29, 1977

[54] HOSE NOZZLE DIVERTER

[76] Inventor: George M. McGrane, 1017 Loma Verde St., Monterey Park, Calif. 91754

[22] Filed: Nov. 17, 1975

[21] Appl. No.: 632,816

[52] U.S. Cl. ..... 239/510; 239/517; 239/519; 239/521

[51] Int. Cl.[2] ..... B05B 1/26

[58] Field of Search ..... 239/503, 505, 507, 437, 239/509–512, 439, 516–519, 521, 523, 452, 524, 602, 381, 382, 389

[56] References Cited

UNITED STATES PATENTS

| | | | |
|---|---|---|---|
| 238,295 | 3/1881 | Killam | 239/521 X |
| 1,087,006 | 2/1914 | Fitzsimons | 239/507 |
| 2,171,023 | 8/1939 | Buxton | 239/602 |
| 3,081,041 | 3/1963 | Showalter | 239/523 X |
| 3,351,291 | 11/1967 | Pohle | 239/517 X |

FOREIGN PATENTS OR APPLICATIONS

| | | | |
|---|---|---|---|
| 220,926 | 4/1910 | Germany | 239/509 |
| 369,542 | 2/1923 | Germany | 239/510 |
| 2,105,337 | 8/1971 | Germany | 239/602 |

*Primary Examiner*—Robert S. Ward, Jr.
*Attorney, Agent, or Firm*—Marvin Jabin

[57] ABSTRACT

A nozzle for coupling a diverter to a hose for the purpose of changing the water stream from the hose into a spray by adjusting the position of the diverter. The nozzle is made out of plastic in one piece and may be connected to a conventional garden hose for selectively converting a solid stream of water into a uniformly distributed thin sheet.

10 Claims, 4 Drawing Figures

HOSE NOZZLE DIVERTER

BACKGROUND OF THE INVENTION

Conventional hose nozzle devices are available for sprinkling and irrigation purposes. Most of such nozzle devices, however, unduly restrict the flow through the hose, so that full capacity of the flow is not available when used for sprinkling or irrigation. Those conventional hose nozzle devices which do permit full flow to issue from the hose are not suitable for use as spraying devices, particularly for substantial distances from the nozzle.

Conventional hose nozzles which can be used for converting a solid stream of water into a thin sheet of water are mechanically too complex and, thus, expensive to manufacture and are difficult for the operator to use.

SUMMARY OF THE INVENTION

According to the preferred embodiment of the present invention, a hose nozzle diverter includes a threaded nozzle which is adapted to be connected to a garden hose and which has a flap at its unthreaded end. The nozzle is made of plastic in one piece and the flap is reinforced with ribs for strength. A person using the nozzle can divert the water stream into a spray by adjusting the position of the flap with his thumb. The reinforcing ribs extend along the sides of the flap to its origin and prevent the flap from breaking off when the flap is repeatedly bent during use.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawing, in which:

DESCRIPTION OF THE PREFERRED EMBODIMENT

Figure 1:
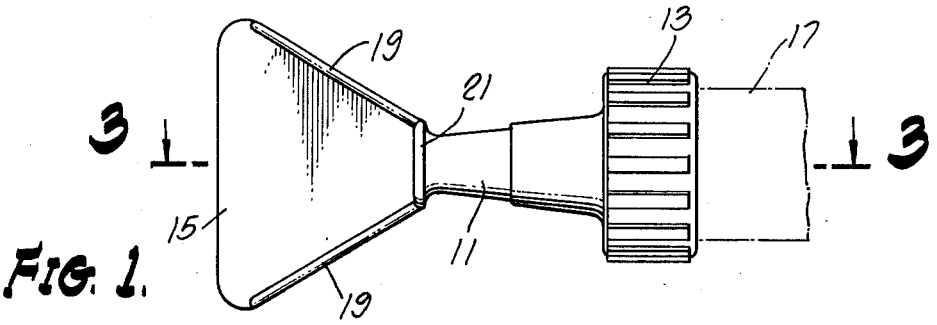
FIG. 1 is a top view of a hose nozzle diverter according to the present invention.
Figure 2:
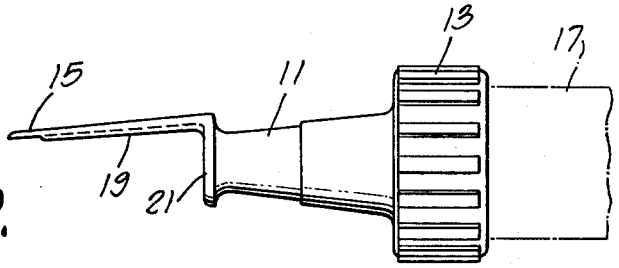
FIG. 2 is a side view of the hose nozzle diverter shown in FIG. 1.

Turning now to the drawings, FIGS. 1 and 2 show nozzle 11 made of plastic in one piece and having threaded end 13 and flexible flap 15 at the other end. Threaded end 13 is adapted for coupling to a conventional garden hose 17. Flexible flap 15 has a rib 19 along each of its sides. The ribs 19 extend to lip 21 and reinforce flexible flap 15 and prevent it from breaking off when it is repeatedly bent during use. It has been found essential to extend ribs 19 along the sides of flap 15 all the way to its origin at lip 21, in order to adequately strengthen flap 15.

Thus, as can be seen in FIG. 1, flexible flap 15 is generally trapezoidal in configuration, and the ribs 19 originate at the shorter of the two parallel sides of flap 15, in order to prevent the flap 15 from breaking off when the flap is repeatedly bent during use.

Figure 3:
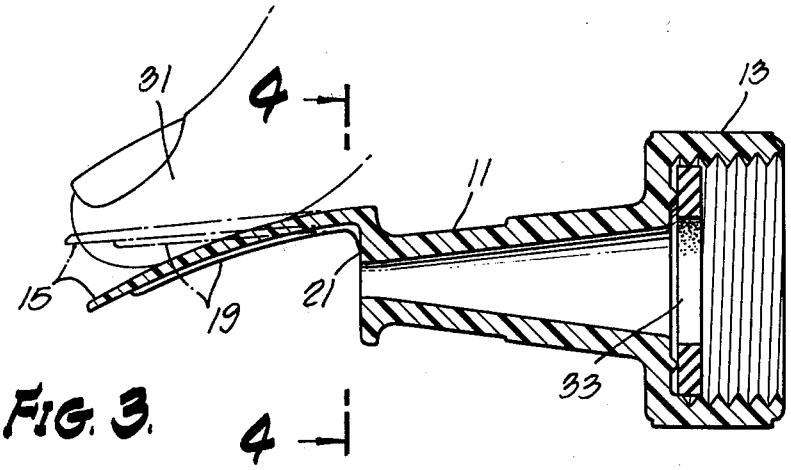
FIG. 3 is a sectional view taken along the line 3—3 of FIG. 1.

FIG. 3 shows what happens when the flexible flap 15 is pressed towards the centerline of nozzle 11 by the finger or thumb 31 of the user, in order to divert the solid stream of water which would ordinarily be emanating from nozzle 11 into a uniformly distributed thin sheet or spray.

The coupling on the garden hose can be screwed into threaded end 13 until it fits snugly against washer 33. The threaded end 13 is conventional in construction.

Figure 4:
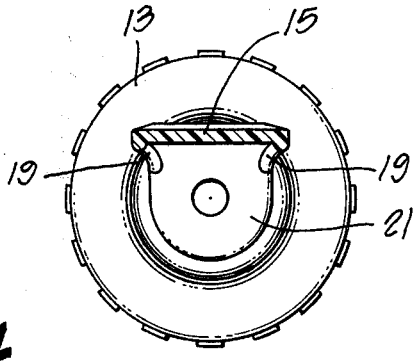
FIG. 4 is a view taken along the line 4—4 of FIG. 3.

FIG. 4 shows how reinforcing ribs 19 extend along the sides of flap 15 to its origin at lip 19.

While particular embodiments of the present invention have been shown and described, it will be obvious to those skilled in the art that changes and modifications may be made without departing from this invention in its broader aspects, and that the intention is to cover all such changes and modifications as fall within the true spirit and scope of this invention.

I claim:

1. Nozzle means for selectively converting a stream from a hose into a spray, comprising:
   a. a first end adapted for coupling to said hose, and
   b. a second end including flexible flap means having at least one reinforcing rib.

2. Apparatus as defined in claim 1 in which said flap means has at least two reinforcing ribs.

3. Apparatus as defined in claim 2 in which said reinforcing ribs extend along the sides of said flap means.

4. Apparatus as defined in claim 3 in which said reinforcing ribs extend along the sides of said flap means to its origin.

5. Apparatus as defined in claim 4 in which said flap means is trapezoidal in configuration and in which said reinforcing ribs originate at the shorter of the two parallel sides thereof.

6. Apparatus as defined in claim 5 in which said nozzle is made of one piece of material.

7. Apparatus as defined in claim 6 in which said nozzle is made of one piece of plastic.

8. Apparatus as defined in claim 7 in which said flap means is adapted for activation by finger pressure exerted by the operator thereof.

9. Apparatus as defined in claim 8 in which said first end is threaded.

10. Apparatus as defined in claim 9 in which said first end is adapted for coupling to a conventional garden water hose.

* * * * *